US008474465B2

(12) United States Patent
Daley

(10) Patent No.: US 8,474,465 B2
(45) Date of Patent: Jul. 2, 2013

(54) HEATED HAIR STYLING CLIP FOR RAPID SETTING OF INFORMAL HAIR STYLES

(76) Inventor: Tina Daley, Chelmsford, MA (US)

( * ) Notice: Subject to any disclaimer, the term of this patent is extended or adjusted under 35 U.S.C. 154(b) by 728 days.

(21) Appl. No.: 12/381,062

(22) Filed: Mar. 6, 2009

(65) Prior Publication Data

US 2009/0223533 A1 Sep. 10, 2009

Related U.S. Application Data

(60) Provisional application No. 61/068,318, filed on Mar. 6, 2008, provisional application No. 61/194,428, filed on Sep. 26, 2008.

(51) Int. Cl.
*A45D 7/02* (2006.01)

(52) U.S. Cl.
USPC ..... 132/211

(58) Field of Classification Search
USPC ..... 132/276, 211, 273, 210, 231, 234, 132/277, 207, 229; 219/222
See application file for complete search history.

(56) References Cited

U.S. PATENT DOCUMENTS

| | | | | | |
|---|---|---|---|---|---|
| 943,321 | A | | 12/1909 | Shero | |
| 2,254,627 | A | * | 9/1941 | Schlicker | 132/227 |
| 2,777,451 | A | * | 1/1957 | Kriesman et al. | 132/234 |
| 2,862,507 | A | * | 12/1958 | Hawthorne | 132/211 |
| 3,526,235 | A | | 9/1970 | Garrett | |
| 4,739,151 | A | | 4/1988 | Smal | |
| 4,849,593 | A | | 7/1989 | Hughes et al. | |
| 5,294,777 | A | * | 3/1994 | Denhup | 219/225 |
| 5,522,407 | A | | 6/1996 | Kelsey | |
| 5,697,388 | A | | 12/1997 | Chang | |
| 6,142,159 | A | * | 11/2000 | Lloyd | 132/278 |
| 2008/0236606 | A1 | | 10/2008 | Flowers | |

FOREIGN PATENT DOCUMENTS

| | | | |
|---|---|---|---|
| KR | 1020040067001 | * | 8/2004 |
| KR | 2004081720 | * | 9/2004 |
| WO | WO2008-118490 A1 | | 10/2008 |

OTHER PUBLICATIONS

U.S. Appl. No. 60/907,265, filed Mar. 27, 2007, Flowers, p. 1-4.

* cited by examiner

*Primary Examiner* — Todd Manahan
*Assistant Examiner* — Brianne Kalach
(74) *Attorney, Agent, or Firm* — Francis H. Kirkpatrick

(57) ABSTRACT

A heated hairstyling clip, optionally with heat-transfer accessories, is provided for rapid informal ("scrunch"-type) hair styling. (To "scrunch" is to crumple, crush or squeeze something tightly together; for example, a handful of hair.) In one embodiment the clip is a pair of concave jaws, optionally with interlocking fingers, held together by a spring mechanism. The hair is set and secured within the heated hairstyling clip, optionally with accessories supplying additional heat, and the clip is then allowed to cool before being removed. The clip is heated by a device, which may be a microwave oven, a conventional oven, a heated bath, or a resistive heating element. Heating of the clip may be supplemented or replaced by a heatable clip liner, held between the clip and the hair being treated, or a heatable clip pad supplying heat to the clip and the hair, or a reservoir within the clip, or a styling element in contact with the hair. The heated clip can be used for the purpose of creating natural looking scrunched styles, tousled body, informal waves or curls, or similar configuration or formation of hair.

1 Claim, 5 Drawing Sheets

HEATED HAIR STYLING CLIP FOR RAPID SETTING OF INFORMAL HAIR STYLES

PRIORITY

This application claims the benefit of the priority of U.S. provisional applications 61/068,318, filed Mar. 6, 2008, and 61/194,428, filed Sep. 26, 2008, which are incorporated herein by reference.

BACKGROUND

It is well known that when hair is arranged into a desired configuration, and then heated and allowed to cool, the hair will then hold the formation in which it was set. The hair will hold this formation for a period of time depending on the method of styling, styling products used, hair length, hair texture, and condition of hair, as well as many other factors; or until the hair is wet or washed, or the styling is removed or unset by extensive combing or brushing, or by any other efforts made to remove the set configuration. There is a clear consumer demand for ever changing hair styles that are quick and easy to achieve. A currently favored style is called the "scrunched" or "tousled" look, in which an informal wavy appearance is set into hair by clamping a handful of hair together while damp or wet and releasing it after it is dry. The resulting informal but wavy styling is currently popular. The technique is simple, but the required drying time means that it takes significant preparation time to achieve. Because the style is fairly new, there are no styling tools on the market that can quickly deliver a "scrunched" look, as well as offer versatility in results, and so many consumers spend lots of time trying to look as though they spent no time at all styling their hair.

Providing such tools is the object of the present invention. Current styling tools, when used to achieve this look, require too much consumer time working with the styling tools, much more coordination by the user, and more skill by the user to operate the tools and create the desired style. This is the case in part because currently available styling tools are designed to create hair finishes that look like they have been set or finished using a styling tool. A user desiring a more unfinished or natural look must then spend time "messing up" the set hair to look informal.

Scrunched hair has a natural, uneven bend to it, or a windblown appearance, not a uniform curl. The sought-after look is that of someone who is born with natural body or wave. A similar look can sometimes be achieved by having the hair permanently chemically waved on various sized rods, and then finishing the look by blow drying the hair while scrunching the hair with hands the entire time, until the hair is completely dry. That method of achieving such desired style is not only very time consuming, but also quite damaging to the hair, especially if the hair is long, and it is permanent until the hair grows out or gets cut off, making it an unfavorable option for many people.

The scrunched look can also be achieved on wet or damp hair by grabbing a section of hair with a hand and squeezing that section of hair together all the way up to the root area against the head, and then securing that section of hair in place with an ordinary clip and leaving the hair clipped in place until it is completely dry. However, this method is very time consuming, even more so than a roller/curler set done on wet hair, because of the time it takes for the hair to dry. Because the hair is scrunched together and then secured within the clip, the wet hair is exposed to very little air, thus making it extremely difficult to fully dry the hair, which is necessary in order to lock in the set. If the hair is removed from its scrunched configuration while still damp, the style will not hold. Furthermore, most consumers would never even think to do this as a method of styling hair at home because a hooded hair dryer, like those used in salons, would be needed to speed up the drying process, which could still take over an hour to complete. Those attempting to set the hair in this manner without applying heat would need to leave the set secured in place for as much as twelve hours, and still it may not be completely dry depending on the length and texture of the hair.

In addition to the scrunched style, there are numerous variants in use to style handfuls or small amounts of hair, including a twist, a twirl, a wrapped curl, a wavy spiral, a braid, a bend, and other configurations of hair clumped alone, or around or within a device used to aid in creating the desired configuration. Such variants, and similar informal styles named using different words, frequently can also be created with the equipment and methods of the invention.

Today's consumer is looking for the fastest method of achieving any desired finished look. There is currently no styling tool available that is capable of replacing the wet method of scrunching hair. The old roller/curler set, in which hair was set on rollers while wet and the rollers were left in the hair until it was dry, was replaced by faster methods of achieving set curls, by using hot rollers or a curling iron on dry hair. Such an improvement is needed for current hair styles.

There is also a need for an improved method of adding simple body to hair in preparation for creating many "up" styles or "up do's". Up styles or "up do's" have been popular hairstyles for as long as women have been doing their hair. An up style is any hairstyle that is secured up onto or against the head, such as a pony tail or a braid, a bun, or a formal twist, and it can be done formally or informally. In essence, hair can be considered to be worn up or in an up style as long as it is not down, and it is secured up against the head using any means available, such as a clip, a hair pin, or an elastic band.

Anyone skilled in the art, including both stylists and those who do their own up do's at home, knows that in order to achieve many up styles it is necessary first to create body, or fullness of texture, to the hair. This enables the hair to become more manageable during the styling process, and creates the proper foundation, or base, for styling and securing the style. The body, or mass, that is added to the hair creates a cushion for securing the hair pins or clips that hold the style in place, and adding such body results in a more appealing finish style as well. Many up styles cannot be achieved without first adding such body to the hair, especially if said hair is naturally straight, or extremely fine.

Currently in order to achieve such body in the hair, the user must set the hair on rollers, use a curling iron, or blow style the hair with a brush while hair is wet. These methods are all unnecessarily time consuming for the user in this case, as it is not necessary that the body created for use as a foundation for an up style be neat. Quite the contrary, because the next step taken to lock in that body is to comb the hair with quick movements toward the root of the hair strand so that the hair stands up away from the head; this is known as "teasing" the hair. Teasing the hair creates a messy appearance that is often referred to as a "rats nest".

As will be described below, the methods developed for forming a scrunch are also suitable for achieving the teased or full bodied effect needed to support an up do. Thus, with the methods and tools of the invention it is not necessary to spend valuable time and effort doing a roller or iron set, or blow styling the hair to create body for this purpose. Instead, the user can quickly and simply clump the hair in large sections and secure it in place with a heated hairstyling clip to achieve such body, leaving time and effort best spent on the finish, rather than the preparation of up style.

Many people are incapable of creating a formal up style on their own hair, or they simply choose not to, and instead prefer to treat themselves at a salon having the up style done by a professional hair stylist if it is affordable. The most time consuming of the up styling process is most often the preparation of the hair, not the actual finish of the style. Most up styles done in a salon are priced according to the time it takes to complete the styling process from start to finish. Usually, the client whose service took one hour will pay about twice as much as that of the client who's service took a half an hour. For example, many stylists tell the client to come in for the service with clean dry hair, because it saves them time, and the client money. If the client chooses to have their hair shampooed and then blown dry by the stylist, the client is going to pay for that service, as they also will pay for the roller or curling iron set that is done only for the purpose of adding body to the hair during preparation, in addition to paying for the up style because this could add an approximate thirty to forty-five minutes to the process. Using heated hair styling clips to create such body will save time for both the stylist and the client, making it more affordable for the client, and that benefits both the client and the stylist, as well as the economy.

The present invention offers a much needed improved means to a simpler and faster method of adding the necessary body or fullness of texture to hair that is pertinent in the success of achieving many popular and classic up styles.

With the present invention, the user will spend much less time achieving such unfinished or informal styles as described throughout this application. The heated hairstyling clips will provide all consumers with a styling tool that is quicker and easier to use, while still being able to create many different finished looks.

There is also the need for a hair styling tool that works for today's busy consumer. All styling tools presently available require the user be confined while using them, either because they need to be plugged in while in use or because the user will look silly going out in public during the process of use, thus slowing the user down.

The present invention is the first heated styling tool designed to process, or to set, a desired hair configuration while the user is on the go, while enabling the user to still look fashionably finished. In other words, the user can, as described more fully below, simply heat their decorative styling clips, or clip liners or pads, then quickly configure or clump their hair and secure it in place with the clip, liner or pad, and immediately go out in public during the heating and cooling process without looking foolish, but actually looking fashionably finished with an up style. A user setting their hair on heated rollers would be considered to look foolish and unfinished if they went out in public with such a set, so such a user would typically wait until the heating and cooling process was finished and the rollers had been removed before going out in public, adding much more time to their styling process than that of someone using decorative heated hair styling clips.

As an added benefit, the user of a decorative heated hair styling clip can wear the up style for as long as they like, and then remove the clip to be left with a scrunched or other informal hairdo whenever they choose. The decorative styling clip will heat and cool through the normal styling process and will then remain in the cool state for as long as it is worn by the user, thus allowing the finished look to be enhanced the longer it is left in, with no worry of causing excess heat damage, no matter how long it is left in the hair. Hence, the present invention clearly fulfills the styling needs of even today's busiest consumers.

The present invention clearly offers a much needed improved means to a simpler and faster method of achieving many desired styles. Furthermore, there is certainly the need for a quick and easy to use styling tool to meet the needs of the consumer that does not want a uniform curl formation, but something much more natural and modern. Because heated hairstyling clips offer a variety of finished styles with the purchase of just one hair styling tool, the present invention can fulfill the styling needs of yesterday's and today's, as well as tomorrow's consumer. Optionally, small devices ("styling inserts", or "inserts") can be provided that will fit inside the styling clips to produce particular effects, such as a "crimped" look. In some cases a clump of hair will be wrapped around such a device. The user can produce several different effects in one session by using such devices.

BACKGROUND

There are many examples of using heated rollers in the art. For example, in U.S. Patent Application No. 2005/0056297, a hair clip is heated while it is secured to a hot roller, where heat is to be transferred from the roller to the clip when attached to the heating unit, for the purpose of aiding the roller in heating the hair that has been wrapped around that roller. This is different from the invention. The clips in '297 are unable to be heated on their own, and '297 does not claim any use as a styling tool apart from aiding the roller that heats them. With the present invention, the actual hair styling clip will be heated on its own, for the primary purpose of being used as the styling tool.

In addition to styling the hair into a scrunched look, the invention's heated hairstyling clips can be used to aid in the use of styling with any concave roller/curler that can be used with heat. The heated hairstyling clips, when desired for the purpose of aiding in roller styling, can be purchased and used with almost any roller/curler the consumer already has, while giving the consumer many other styling options which can be achieved when using them on their own as well.

U.S. Pat. No. 5,294,777 discloses the use of a hair clip that includes a pair of interior metal plates that are heated by applying them to an electric heating unit. These heated hair clips are used to style dry or damp hair into a linear configuration generally perpendicular to the scalp. These heated hair clips have only a limited use for producing lift and volume at the root of the hair; they cannot be used to secure a hair curler/roller or to create styles resulting in scrunched styles, waves or curls throughout the entire hair strand.

U.S. Pat. No. 5,522,407 discloses a heatable hair clip having flat plate faces that is used with a U-shaped hair curler and a small clip to hold the hair on the curler as a method of curling hair. Hair is configured onto the U-shaped hair curler, a small clip is used to hold the hair in place on the curler, and the heated clip is then placed over the curler and small clip to set the hair. An electric heating unit is used to heat the heatable plates of the clips until they are applied to the hair. It is stated in '407 that these clips can be used with other curlers, or be applied directly to the hair. This may be true, but with great limitation because of the structure of the clip. These clips are not capable of being used in the same manner as the present invention, due to their flat, perpendicular shape. They lack the ability to aid the average circular roller/curler with securing and styling the hair, and they certainly lack the ability to produce the scrunched finished looks, due to their flat interior, as well as due to the pattern of the hair inside the assembled device.

U.S. Pat. No. 3,949,766 describes a clip which holds a flat heated spool in one jaw and presses hair between the heated spool and the other flat clip jaw. It is incapable of providing the scrunched look.

U.S. Pat. No. 4,849,593 provides roller cartridges that can be heated in a microwave and used to roll up hair to set it into curls. Optionally, the cartridges can be carried inside a curling-iron type of device. The objective is to heat hair without having electricity present in the device, but the physical form is still not useful for the scrunched or informal look.

Although some of the hair configurations intended to be achieved using the present invention require some skill from the user, the method of styling is still easier and quicker than that of the prior art. But more importantly, the main intention of the present invention is to achieve the natural look of tousled, scrunched hair, and that cannot be achieved using any of the prior art devices. In contrast, with the present invention, it is possible for any user to achieve scrunched and similar informal styles simply and quickly.

SUMMARY OF THE INVENTION

A heated hairstyling clip is described, as well as accessory devices, for rapidly setting hair into a scrunched or other informal look. In one embodiment the clip consists of a pair of concave jaws, which when in their closed styling position are held together by a durable spring mechanism at one end. Finger grips are attached to the durable spring mechanism for easy operation of opening and holding closed the jaws. The jaws optionally have interlocking fingers at their other side for securing the clip to the hair when in its normally closed styling position. The heated clip can be used as a hair styling tool for the purpose of creating natural looking scrunched styles and the like, when hair is set and secured within the heated hairstyling clip, and the clip is allowed to cool before being removed.

The clip can be heated by any convenient mechanism. A preferred heating mechanism is to heat the clip in a microwave oven. (Microwaving is preferred because it is fast and convenient.) A clip for this application must be made of microwave-compatible materials for safety. Microwave compatible styling tools can be manufactured of appropriate plastics which can retain the heat energy necessary for setting hair.

Alternatively, heating can be obtained by the use of resistance wire within the clip to allow direct heating of the clip by electricity from a source. Another heating mechanism is heating in a conventional convection oven.

The heat delivered by the clip is limited by its mass. In another embodiment, the mass of a clip or similar device is enhanced by the use of a "clip liner". A clip liner is a pad about the same size as the clip when the clip is opened, made of a material sufficiently flexible to conform to the inner side of the clip when the clip is closed. The pad is made of, or filled with, microwave-absorbing solid materials, for example small particles such as rice or beans or other non-melting materials. In addition, or instead, a "clip pad" can be affixed to the outside of the clip. The pad can supply heat to the clip and also directly to hair that is not obscured by the clip. It can be made of the same sorts of materials used with the clip liner.

Alternatively, the clip liner or pad can be filled with water, as a liquid, or as a gel or other combination of water with a solid, and sealed sufficiently to prevent escape of the water during heating cycles. In addition, or alternatively, a clip may have a compartment which can contain water, or a water-based solution or gel, or another heat-receiving substance, which may be any material which is compatible with the heat source. This allows the filling, at least in part, of a compartment in the clip with water or other heated or heat-receiving material. In any of these variants, when the clip and liner or pad or compartment is heated, it will retain more heat energy at a given temperature and be more effective in setting hair. Heat-receiving materials are selected so that they can be heated by the heating means to be used, for example by conventional microwave ovens. For example, powders of inorganic materials, such as sand, can be suitable if they are stable under repeated heating. Heat receiving materials are also selected for ability to absorb heat from the heating source, particularly when heating is by microwave. Such additions increase the effective weight of the clip. If necessary, because of the weight of any particular clip with such enhancements, a pin or other retaining element may be needed to help keep the clip securely in place in the hair during use.

In another embodiment of the invention, a clip can be designed so that the interior of the jaws of the clip can be simply concave, said jaws having an area within that is sufficient to accommodate removable attachments of various shapes and patterns, each attachment having been designed to achieve a specific resulting finish to the hair that is set and secured within it.

In another embodiment, a styling insert for inserting inside a hollow clip could be made with ridges of various size and separation to enhance such finishes as the scrunch, crimp or wave, or the attachment can simply be made concave, like the original jaw, for the purpose of tightening any scrunched configuration of hair that is set within, thus allowing the user to create more finishes using heated hair styling clips. Attachments and inserts can be changed faster than the style trends change, thus ensuring the longevity of usefulness of particular clips used in the present invention.

In another embodiment of the invention, clip liners and clip pads can be used alone or together, with a specifically designed clip, or with many other clips the user already has, and they can be designed to be functional, or to be decorative, as well as functional for the purpose of styling on the go.

In another embodiment of the invention, a clip can have an opening in one or both ends thereof. The opening can accommodate inserts to assist in forming a scrunch, or can allow for exchange of heated inserts inside the clip.

In one aspect, the invention comprises a system for scrunching hair, the system comprising one or more heatable clips having contacting concave jaws, and a heating system suitable for the heating of said clip; wherein the one or more clips are heated by the heating system and then are applied to secure hair that has been formed into an appropriate clump, so that the heating of said clump produces the desired styling effect after heating of the hair by said one or more clips.

The heating system for the clip may be selected from one or more of an internal electric current, a microwave oven, a conventional oven, contact with hot liquid, and contact with at least one hot surface. In one embodiment, the method of heating may be electric current, and the material of the clip will then comprise metal heated by the current, for example a length of Nichrome wire or a functional equivalent thereof.

In another embodiment, the means of heating is a microwave oven and the clip is made of materials compatible with microwave heating, or the means of heating may be a conventional oven. In another embodiment, the concave jaws may have one or more hair-engaging members selected from interdigitating fingers and interlocking nubs or tooth-like regions on their edges, and the concave jaws may have prongs that penetrate the concave space that is formed by the jaws within the clips, to firmly immobilize the clip on the hair being treated.

In another embodiment, the system may further comprise one or more clip liners which are heated and held against the hair to be treated by the clips, or may comprise one or more reversibly attached clip pads that are separately heatable and attached to the outside of a clip.

In another aspect, the invention is a method for styling hair, the method comprising: manually gathering hair into a scrunch; applying a heated concave clip to the scrunch; and removing the clip after it has cooled. The scrunch may be moist, or moistened with a styling product, before the clip is applied. A multiplicity of clips may be applied to the hair to establish an overall scrunched effect in the styling.

The heated clip may have interdigitating jaws. The concave clip may be heated by a method selected from resistance heating, microwaving, warming in an oven, contacting with hot liquid, and contacting with at least one hot surface. The application of the clip to the hair may further include at least one of application of a separately heatable clip liner to the hair, inside the clip, and application of a separately heatable clip pad to the outside of the clip. Preferably, one or both of the clip liner and the clip pad is heated before its application to the hair.

In another aspect, a single heated clip is used to scrunch hair, wherein the clip is heated and is applied sequentially to regions of hair to be heated to produce a scrunched effect. The clip is preferably heated continuously by an electric current. The single clip may be periodically reheated in one of an oven, hot plate, microwave, or water bath, or other heating system. Further, the effect of the clip may be augmented by the use of one of a clip liner and an external heated pad attached to the clip.

In another aspect, the invention provides a scrunch hairdo, created by the process of heating one or more styling clips; applying said clips to selected areas of the hair; heating the selected area of hair with the heated clip for a sufficient time to fix a shape in the selected hair; and releasing the clip to allow the hair to assume the scrunch style hairdo. In such a scrunch hairdo, the effect of the clip may be enhanced by the provision of at least one of a heated clip liner and a heatable detachable external clip pad. Or, the heating effect of the clip may be enhanced or prolonged by addition of mass to the clip, for example by way of a fillable compartment.

DESCRIPTION OF THE INVENTION

"Scrunch" is a relatively recent term for a loosely curled, informal tousled hair style. Using a heated hair styling clip, a scrunch is made by taking a handful of hair, optionally damp, preferably wound in loops or the like, and then pressing the hair together ("scrunched"). The hair is held together with the clip, and the clip heats and sets the hair, and is removed after it has cooled. The heating cycle may be repeated if needed.

Figure 1A:
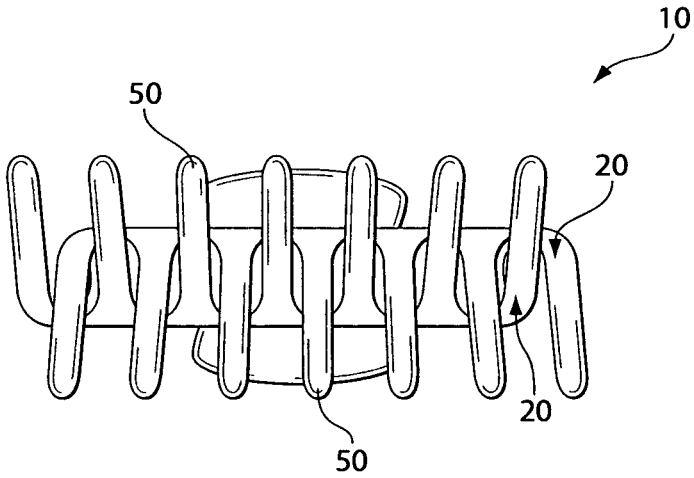
FIG. 1 shows side and end views of a first example of a heatable clip of the invention.

FIG. 1 shows a heatable hair styling clip suitable for use in the invention, in side view (1A) and end view (1B). The clip 10 has a pair of normally closed jaws 20, carrying fingers 50 at one end, and a durable spring mechanism 30 for the purpose of opening and securing said jaws at the other end. Tabs 40 are pressed together to separate the jaws 20 and fingers 50.

Figure 1B:
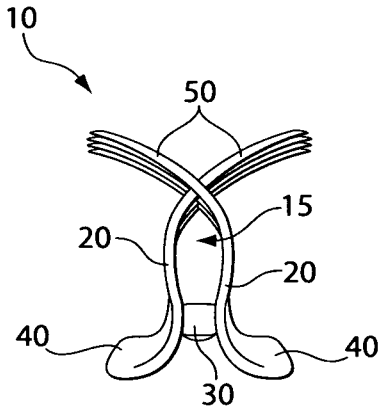
Figure 2:
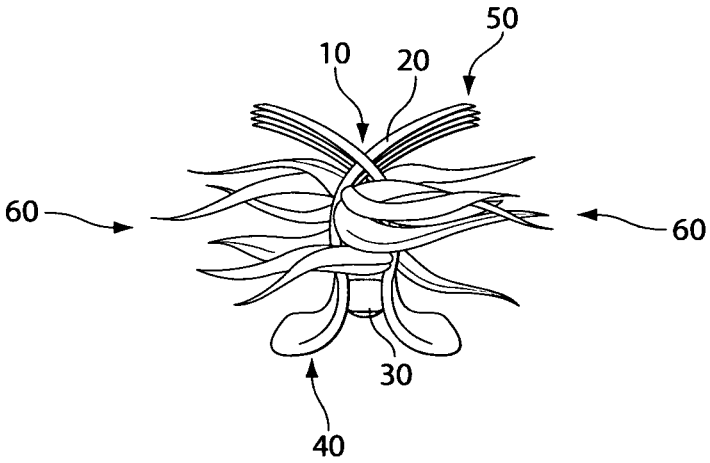
FIG. 2 shows the application of the clip of FIG. 3 to achieve a local scrunched look.
Figure 3:
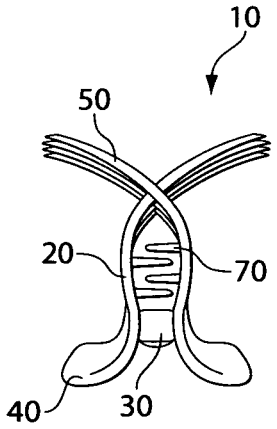
FIG. 3 shows a clip with stabilizing prongs in the interior.

FIG. 2 schematically shows a twist of hair 60 caught up in device 10. FIG. 3 shows the clip 10 of FIG. 1 with prongs 70 to help immobilize and help set the interior of hair twist 60.

The hair styling clip can be made of any material that is capable of being heated repeatedly while retaining sufficient rigidity. Examples of materials include metal, ceramic, wood, and rigid or semi-rigid plastics with high melting or softening points, such as, without limitation, nylons, polyurethanes, polycarbonates, and some polyacrylates, as well as composites of plastic with reinforcing materials. In particular, the clip will be constructed of material to suit the particular heating method to be used, including but not limited to:

- heating in a microwave;
- heating in a convection oven;
- heating with a ceramic or metal heater, to which the clip is clipped during heating;
- heated from the inside out when attached to an electrical heating unit or base, similar to how a hot roller/curler is heated when placed on a heating base;
- heating via an internal resistance, by passing electric current through the device, for example using a plug in adaptor;
- and heating by immersion in hot water or other liquid.

The materials used for the clip must be coordinated with the heating source provided. For example, an all-metal construction would most likely not be suitable if heating by microwave (but ceramic or plastic could be), while non-rusting metal would be fast to heat in hot water, or via electrical conduction, and would transfer heat rapidly to the hair. Any of these would preferably be covered or partially covered with a heat-tolerant plastic for decorative purposes or to prevent burns, making it a safer styling option for younger users. All-plastic clips, or plastic clips with metal springs, are preferred embodiments because fabrication costs are typically lower.

The clips can be constructed using a variety of interior designs within the jaws for the purpose of accommodating and allowing all lengths and textures of hair to fit within the heated interior of the clip. A simple clip design will have a vacant hollow space 15 in the inside once closed on the hair, as seen in FIG. 1B. As shown in FIG. 3, one version of the clip may have heated prongs 70 extending perpendicular to the interior walls of the clip (when closed) for the purpose of heating long or thick hair in the centermost portions of the hair configuration that has been formed within the clip, and also for adding extra volume to the hair. Yet other versions of the hair clip may have ridges of various sizes within the interior of the hair clip for the purpose of creating finished looks such as the crimp or the finger wave (not illustrated), or to accommodate shorter hair lengths. Such ridges can be fabricated into the clip. Alternatively, for flexibility in application, styling inserts for the clip can have patterned surfaces which can pattern hair pressed against the insert by the clip.

Figure 4A:
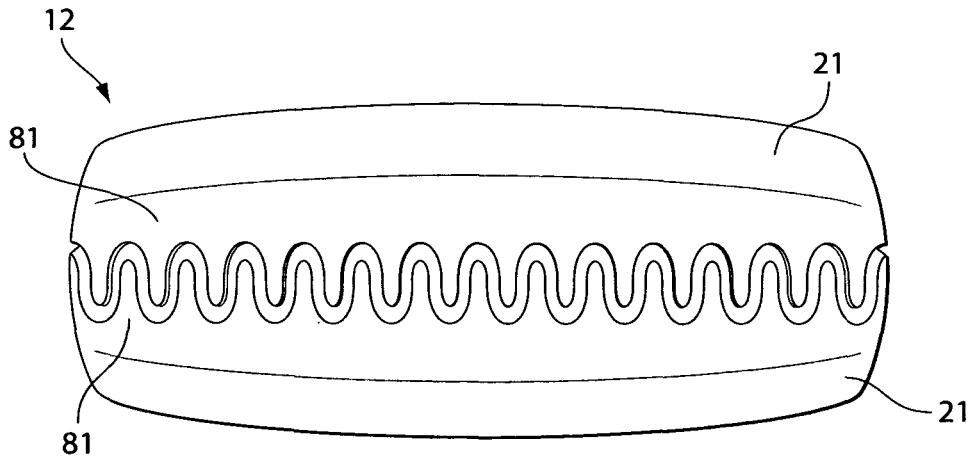
FIG. 4 shows an alternate clip design in which the outer edges of the concave jaws are smooth, and optionally wavy, in contrast to the interdigitating fingers of the version of previous figures.
Figure 4B:
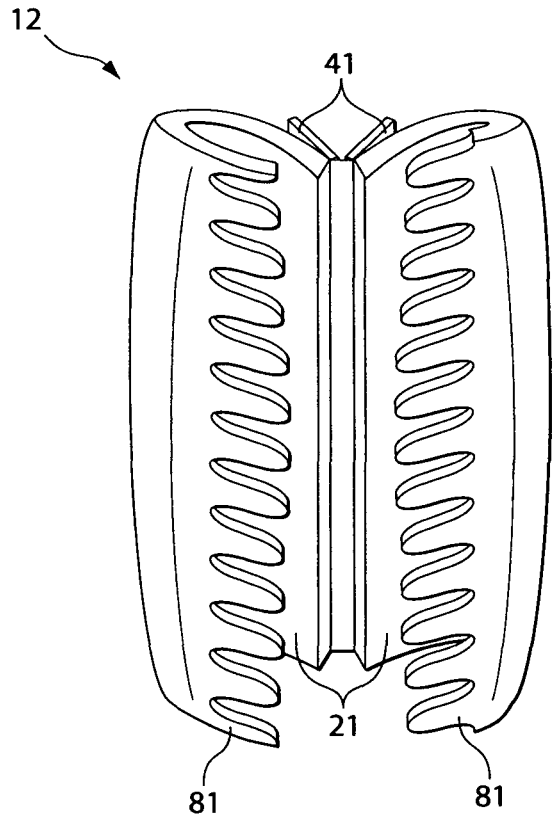

Other versions of the clip may have jaws that clamp together, as in FIG. 4, in which can be seen, both in closed position FIG. 4A and open position FIG. 4B, device 12 with jaws 21, tabs 41 for opening, a spring (not shown), and blunt edge projections 81 which nest to grip hair running through the cavity, which is equivalent to cavity 15 of FIG. 1B, but not seen as such in these views. The fingers 50 of FIG. 1 are not present.

While their exterior designs will generally be similar, the clips will be manufactured in various sizes, having many various interior design molds, in order to accommodate the many different hairstyles or finished looks that the user may be intending to achieve. The jaws of those clips which rest closest to the scalp, and/or the prongs that interlock to secure the clip to the hair, will preferably be made of a cool and comfortable material, for example a material or region of the clip that is not heated as much as the active jaws of the clip, so as not to cause discomfort to the user, or breakage to the hair. Whereas all of the hair configurations in need of being heated will be secured within the interior of the jaws of the clip, the exterior of the clip can be made of material that will not be too hot to the touch, making it easy to grip and control the spring mechanism which is used for opening and closing the clip. For example, the exterior could be covered with an expanded material, such as foam, so that heat transmission to the exterior, away from the hair being styled, is slower.

The clips will be packaged in various quantities of clips per styling kit in order to serve the needs of the consumer. The clips will be available in many varieties of size and interior shape. There will also be travel-sized kits available, as well as a variety of jumbo sized decorative clips. Such clips can be heated and then used to secure the hair into a twist or an "up" style of choice, while at the same time the clip is also working to set the hair configuration if the clip was heated before it was used to secure the desired style.

The heated hair styling clip will give the user the benefit of styling on the go while still looking fashionable and informally finished, allowing the user to set the hair in the morning for an up style, and later removing the clip for a scrunched style full of body when the user chooses to change his or her look. In this mode, a decorative but heatable clip could be used to capture hair in a style suitable for wear in an office, and later released to create a more informal look after work. These styling clips and the associated methods of use will be particularly useful for people who need to change their look quickly, for example, actors and actresses, models and dancers, who may change costumes and hair styles several times during a performance.

Directly heatable clips may be sold together with any necessary heating base unit, which in one version of the invention may be used to house and store the clips when not in use, as well as used to heat the clips prior to use. Other types of heatable clips will be constructed with the intention of being heated by another capable method, such as being heated via an electrical source, similar to a charger, or by a microwave heater. In any embodiment, clips may be provided with suitable accessories, such as a charger/heating base, or a heating and storage pouch. When necessary, there will be an area of the clip that will be designed to attach to a heating base, or to a charger, for connecting the clips for heating.

Heat Enhancing Clip Liners

To become curled, the hair needs to be set for a certain time and temperature. These are usually not stated explicitly, and differ according to the amount of hair being curled, its wetness, and the device being used, but they are quickly learned in practice by anyone learning to curl hair. In cases where the hair is thick or wet, obtaining enough heat from a passively heated device—whether roller or scrunching clip—can require more than one heating cycle, which is inconvenient.

Figure 5A:
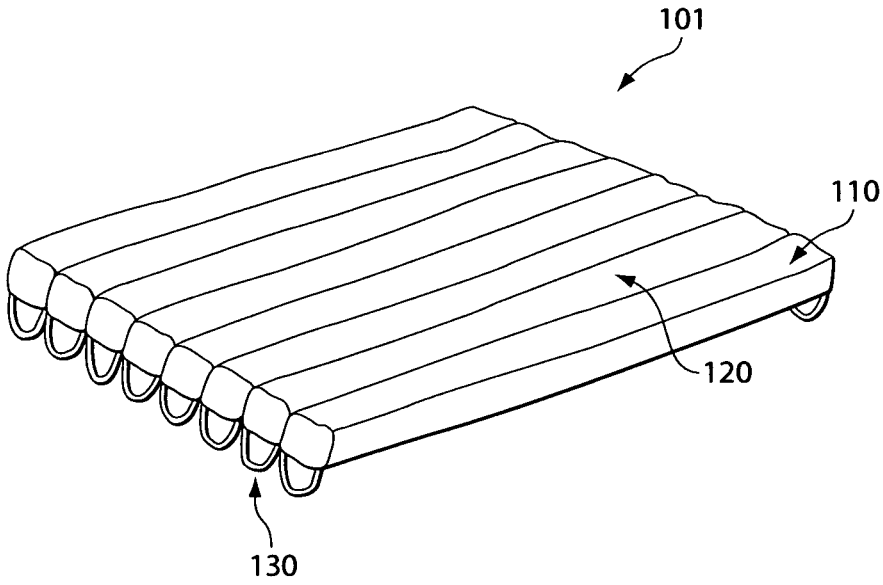
FIG. 5 shows one embodiment of a clip liner of the invention.
Figure 5B:
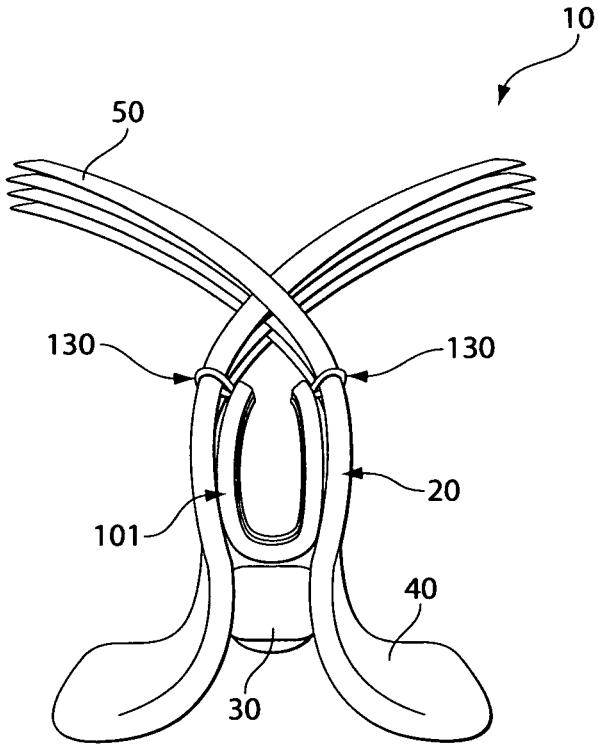

To increase the amount of heat that can be conveyed to hair during scrunching, or other clip-based styling method, a clip liner can be heated and attached to a scrunching clip. A clip liner is preferably at least somewhat flexible, so that it can form a layer inside the curving jaws of a clip, as shown in FIGS. 5A and 5B. It may be a simple pad, shown in FIG. 5A as 101, typically wider than it is thick, optionally with compartments 110 defined by walls or seams 120, for attachment to a clip. If the clip has projecting fingers, as in FIG. 1, then the clip liner can have loops 130 to slide over the fingers, if desired for a more secure connection. Clips and pads can be heated together and applied; or applied separately after heating. FIG. 5B shows an example of the pad 101 of FIG. 5A inside a clip 10 of FIG. 1, the clip 10 having jaws 20, spring 30, tabs 40, and fingers 50, where the pad is held in place by loops 130 over fingers 50.

Most materials with adequate flexibility that can withstand the selected form of heating can be suitable in a clip pad. Materials can include any plastic or solid resistant to the particular mode of heating, whether microwave or other. Coverings, if provided, can be cloth, plastic or other flexible materials. Materials inside an outer covering can be granular (like bean bags), which allows for flexibility and for close contact of heated materials with hair being heated. Prototypes have used simple, safe materials such as uncooked rice and beans.

Because of its high heat capacity, water is an excellent medium for transmitting heat. A flexible sack partially filled with water can conform well to hair when applied with a hollow clip, which optionally is itself heated. The water could be at least partially immobilized by formation of a hydrogel with a polymer (for example, "Water-Lok"™) or other gelling agent. The water could be immobilized by absorption onto an excess of flexible or granular absorbent, contributing heat capacity without being runny. In any application in which water, or any other easily volatilized material, is placed in a sealed compartment as part of a clip liner, provisions to prevent overheating of the bag are desirable, together with safety precautions such as seams or shell materials that melt below the boiling point of water, or a lesser temperature at which the bag would explode.

In some cases, it may be expedient to heat the clip liners separately from the clips. The heated liners can be held in an insulated bag or box, and rapidly exchanged with liners that have cooled. The clips themselves likewise can be heated, or kept hot, and exchanged as they cool. Such uses would favor the use of an oven with a thermostat as a primary heating mechanism, which would in turn diminish the need for safety precautions if liquid-filled clips or clip liners are used. For rapid heating, clips and/or clip liners could be immersed in hot liquid, for example water. However, it would be preferable to place the clips and liners inside plastic bags in the liquid, and remove them from the bags without removing the bag from the liquid, to avoid evaporative cooling of the liners and clips.

In addition to clip liners, clips can gain more ability to store heat by having extra mass on the outside of the concave jaws. This could be provided by a clip-on or otherwise reversibly-attachable pad of any material, preferably insulated on the side of the pad away from the styling clip (i.e., on the "outside" of the pad relative to the styling clip.) The pad will bend, or be curved, so as to adapt to the clip in a conforming way to increase heat transfer. It can be heated separately by any of the means discussed for the clip or for the liner. Materials suitable for the liner will generally be suitable for the external pad, but preferred materials will be stiff enough to be easily manipulated, removed and replaced when the clip is maintained in application to the hair. The use of a pad allows the clip to be left in a particular position and be supplied by heat by exchange of pads if needed. Pads could clip onto the edges of the clip, or they could be held on by snaps, hook-loop closures ("Velcro"®), or other conventional retaining devices. If the hair is dense enough, they can simply be tucked in place.

Reference has generally been made to "clips", but in some embodiments there may be one clip, sequentially applied to areas of hair to be scrunched until the desired effect is achieved. For such uses, a single styling clip may be attached to a handle, and warmed by having a cord that plugs in on the other end of the handle, keeping the clip hot while in use (until unplugged) for the purpose of manually setting a scrunch in one section of hair at a time. The clip could also be heated by exposure to an oven, microwave, or hot plate. The single clip would be most useful when only a limited region of the hair is being scrunched or otherwise informally styled.

Figure 6:
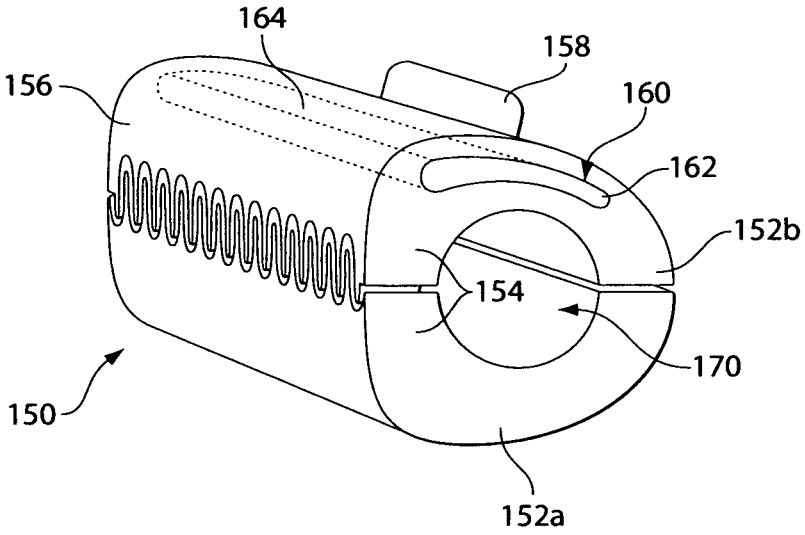
FIG. 6 shows a clip design with a compartment for filling with heatable material, and an end opening for the exchange of inserts.

In another option, illustrated in FIG. 6, a clip 150 is comprised of two sections 152*a* and 152*b*, which in this particular embodiment are identical. Each section 152*a* has a main body formed of two pieces 152*a* and 152*b*, optional end plates 154 partially closing the end of the device 150, optional interlocking teeth 156, a tab 158 to be pressed to open the clip, and a spring (not shown) connecting the two pieces 152*a*, 152*b* to hold the clip parts together in a normally closed position. The clip 150 also may have, in each section 152*a,b*, a reservoir 160 with opening 162 and a cavity 164 (dotted lines) contained within each section 152. The reservoir 160 is filled or partially filled with a heat-absorbing material, not shown, selected to be compatible with the proposed method or methods of heating for the clip 150. The material can be retained in the reservoir 160 with a flexible plug or cap (not shown). In one embodiment, the material is silicon carbide powder. Or, the material can be sand, or water, or gelled water. Many other nontoxic materials capable of reversibly absorbing heat, and preferably capable of being heated in a conventional microwave oven, are of use in the invention.

In the particular embodiment shown in FIG. 6, there is an opening 170 on each end of the clip 150, allowing direct access to the interior of the clip. The opening 170 is formed to allow access to the interior, or insertion and removal of heating pads etc. The end plates 154, which define opening 170, are capable of substantially confining the hair being treated to the interior of the clip, so that all of it is treated. The interior of the clip may be free of additional elements, as shown here, or may have interior teeth or other elements as shown in previous fixtures, for example FIG. 3. The openings 170 can also serve for the introduction of non-fixed styling elements, described above.

Uses:

The present invention meets the needs of the consumer looking for the option of a quick method of creating a natural looking modern hairstyle. Various finished looks are achieved depending on the texture and length of the hair, how the hair is configured before being clipped, how many clips are used, how much hair is configured within each clip, and how long the clips are left in the hair to cool before being removed. The heated clips can also simply be used to secure any roller or curler while aiding in the process of heating the hair and adding body to the root area. Hair can be scrunched, or configured into any pattern, and then secured in place with a heated clip, which is then left in place and allowed to cool before being removed. Hair clips can be used in any number, depending on the desired look the user is trying to achieve.

Moreover, heated clips and their accessories can be easily used by the consumer to create many related informal hair styles, including, but not limited to a tousled scrunch, natural looking body, waves, curls of various size and shape, spiraled looks, crimped looks or other styles the user chooses to create. All of these variants of the scrunched look allow the rapid creation of informal hair styles by a professional stylist, or at home. For example, to create a spiraled curl, the user will configure the hair into a spiral formation by twisting the hair from the root down to the end and then wrapping it from the end back up to the root around a finger bringing twisted hair to the root in a circular shape, before securing it with a heated clip. The user can also simply roll a section of hair from the end up to the root and secure it with a clip to form a C-shaped curl. The user can wrap a length of hair in a piece of cloth and roll or wad it up to be heated into a tousled effect.

The user can create a "crimped" or finely waved informal look by braiding the hair to be crimped, optionally rolling it up, and setting it with heated clips, preferably with pads or liners. When un-braided, the hair will have the crimped look. This can be done one area at a time, or all over at once (with enough clips.) At present, this effect is achieved at home by braiding hair and sleeping overnight with the braids—which is not adaptable to deciding on a particular hairdo for tonight. Crimping can also be achieved with an iron, but since only one section at a time can be crimped, the process is tedious.

The user can be as creative as he or she wants to with the configurations set within the clips, or the user can simply grab a section of hair and clump it together within a clip, or use the clip as a scoop to gather the hair. In all of these embodiments, the heated or heatable clip, optionally accompanied by accessories such as clip liners and clip pads, creates an informal styling effect by heating hair held in the clip, resulting in hair that is wavy but not tightly curled. In some instances, the clip primarily serves to hold a heated pad or liner against hair to be heated, and in such cases the clip is not necessarily heated.

Because of this flexibility, it is possible using only clips, optionally with pads or liners, to set multiple variants of hair style in one sitting. One can for example scrunch one section of hair, crimp a second, twirl a third, and leave other sections straight, creating "streaks" of different styles in the hair.

It is my intention to portray, in the above discussion and examples, a "generic" clip for the purpose of creating an understanding as to how the clip will function, and the styling tasks that it will perform. The exact look of the clip will have many variations from that of the "generic" clip shown in this application. A person of ordinary skill in the art will understand that the purpose of the included drawings is to show a version of the clip to explain its function, and it is to be understood that there is no limitation to the design or constructed material of any clip. The present invention claims any hair styling clip that can be heated by any means, for the purpose of creating any hairstyle, limited only by the scope of the claims and not by the particular examples.

The invention claimed is:

1. A method for styling, hair, the method comprising:

providing a hair styling clip, said hair styling clip comprising two claws, each claw carrying a series of aligned prongs;

placing a heated clip liner within said hair styling clip, said clip liner having a width and two opposed ends having a length that extends the width of the clip liner, and a series of loops extending the length of both opposed ends of the clip liner;

coupling said clip liner with said styling clip by fitting individual loops of the liner over individual prongs of the styling clip;

manually gathering a section of hair and arranging it in a clump;

placing the clump into said heated clip liner;

leaving the heated clip and clip liner on the clumped hair; and removing the heated clip and clip liner after the clip liner has cooled.

* * * * *